United States Patent [19]

Aviram et al.

[11] Patent Number: 4,491,432

[45] Date of Patent: Jan. 1, 1985

[54] CHEMICAL HEAT AMPLIFICATION IN THERMAL TRANSFER PRINTING

[75] Inventors: Ari Aviram; Kwang K. Shih, both of Yorktown Heights, N.Y.

[73] Assignee: International Business Machines Corporation, Armonk, N.Y.

[21] Appl. No.: 454,814

[22] Filed: Dec. 30, 1982

[51] Int. Cl.[3] ..... B41J 31/02

[52] U.S. Cl. ..... 400/241.1; 400/118; 400/120; 428/913; 428/914

[58] Field of Search ..... 400/118, 119, 120, 241, 400/241.1; 346/76 R, 76 L; 428/913, 914; 204/181 C; 423/344

[56] References Cited

U.S. PATENT DOCUMENTS

| | | | |
|---|---|---|---|
| 1,560,885 | 11/1925 | Walter | 423/344 |
| 2,982,619 | 5/1961 | Long | 423/344 X |
| 3,744,611 | 7/1973 | Montanari et al. | 400/120 |
| 4,268,368 | 5/1981 | Aviram et al. | 204/181 C |

OTHER PUBLICATIONS

IBM Technical Disclosure Bulletin, "Electrothermic Printing Method and Apparatus Using a Photoconductor and Fusible Ink", Aviram, vol. 20, No. 2, Jul. 1977, pp. 808–809.

IBM Technical Disclosure Bulletin, "Thermal Biasing Technique for Electrothermic Printing", Wilbur, vol. 23, No. 9, Feb. 1981, p. 4302.

IBM Technical Disclosure Bulletin, "Electrothermal Print Head", Wilbur, vol. 23, No. 9, Feb. 1981, pp. 4305–4306.

IBM Technical Disclosure Bulletin, "Polypyrrole Toluensulfonate Films for Resistive Ribbon", Diaz et al., vol. 23, No. 12, May 1981, p. 5552.

Soviet Powder Metallurgy and Metal Ceramics, "Solid-Phase Synthesis of Some Transistion Metal Silicides", Voronov et al., vol. 13, No. 12 (144), pp. 962–965, published May 1975.

*Primary Examiner*—Ernest T. Wright, Jr.

*Attorney, Agent, or Firm*—Jackson E. Stanland

[57] ABSTRACT

Chemical heat amplification is provided in thermal transfer printing, wherein some of the heat necessary for melting and transferring ink from a solid fusible layer in a ribbon to a receiving medium is provided by an exothermic reaction. This chemical reaction is due to an exothermic material that is located in the ink layer, or in another layer of the ink bearing ribbon. The exothermic reaction reduces the amount of the input power which must be applied either electrically or with electromagnetic waves. Examples of suitable exothermic materials are those which will provide heat within the operative temperature range of the ink, and include nonaromatic azo compounds, peroxides, and strained valence compounds, such as monomers, dimers, trimers, of the type which change their chemical bonding when they decompose to either a valence isomer or break into a number of molecular species.

31 Claims, 7 Drawing Figures

FIG. 1.1
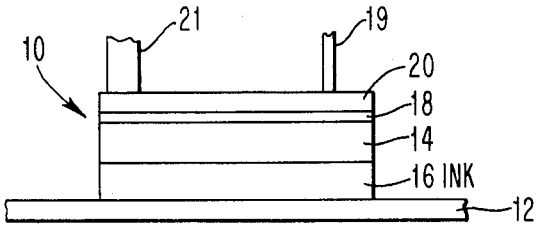
FIG. 1.2
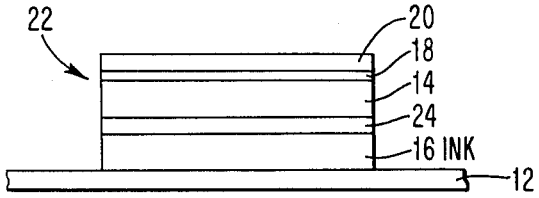
FIG. 2
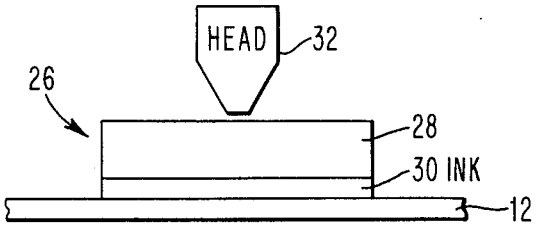
FIG. 3
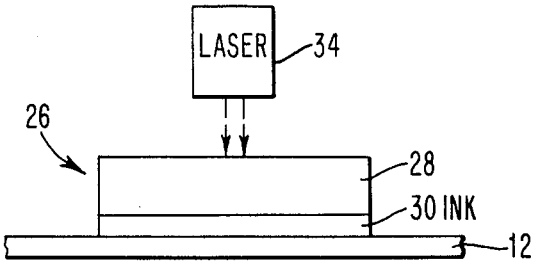

FIG. 4.1
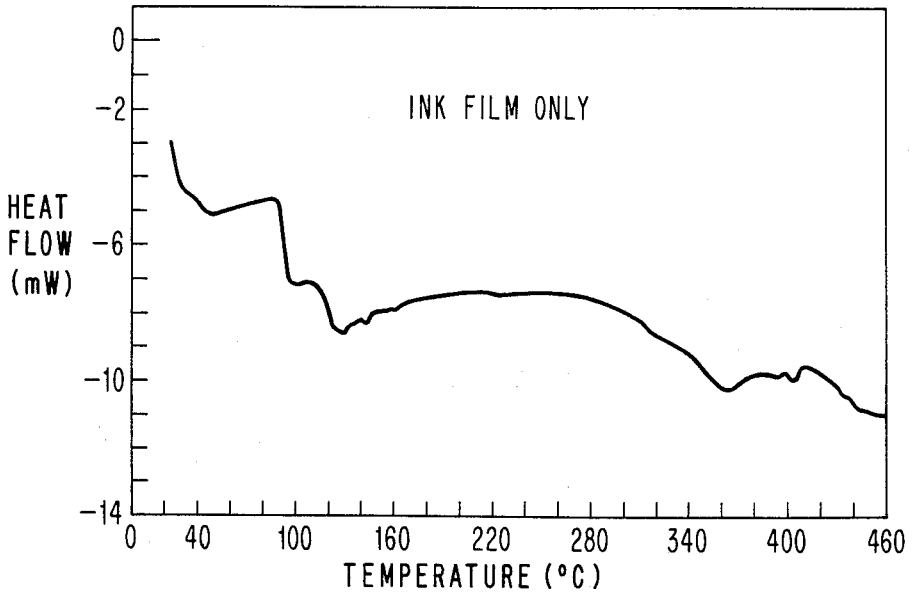
FIG. 4.2
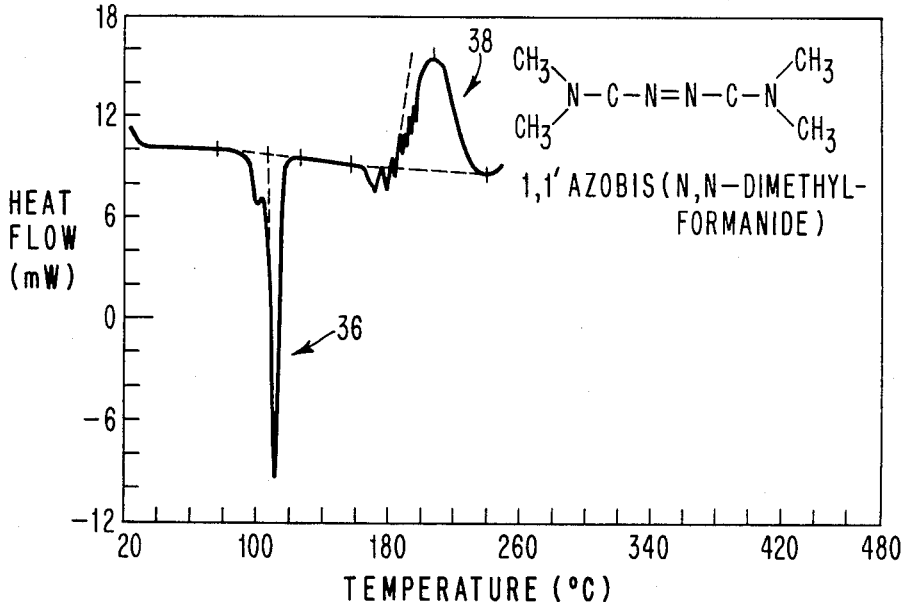

FIG. 4.3
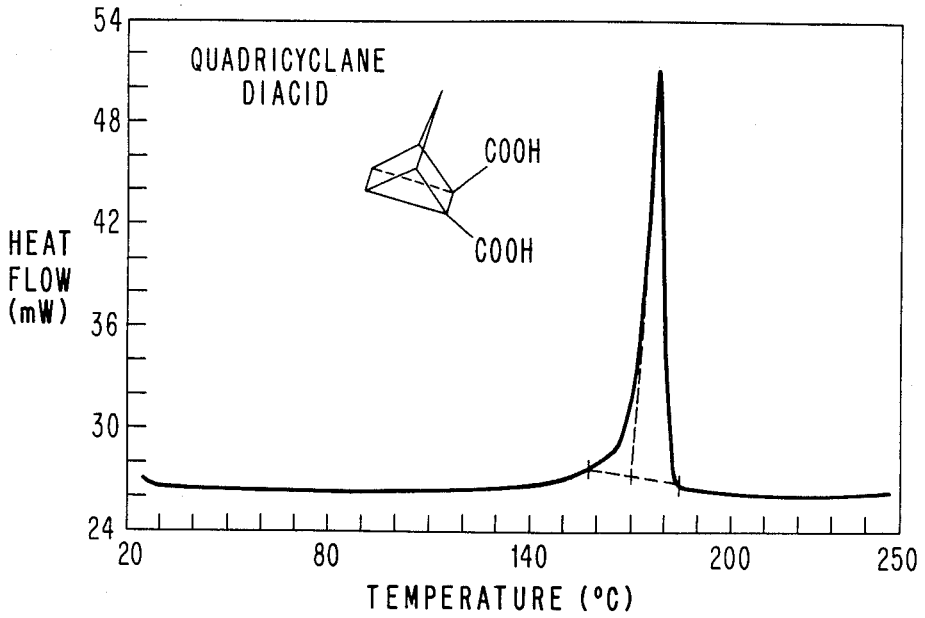

CHEMICAL HEAT AMPLIFICATION IN THERMAL TRANSFER PRINTING

TECHNICAL FIELD

This invention relates to thermal transfer printing and more particularly to a technique and apparatus for providing heat amplification to effect thermal transfer of ink, where the heat amplification is chemically provided.

BACKGROUND ART

Thermal transfer printing is one type of non-impact printing which is becoming increasingly popular as a technique for producing high quality printed materials. Applications exist in providing low volume printing such as that used in computer terminals and typewriters. In this type of printing, ink is printed on the face of a receiving material (such as paper) whenever a fusible ink layer is brought into contact with the receiving surface, and is softened by a source of thermal energy. The thermal energy causes the ink to locally melt and transfer to the receiving surface.

The thermal energy is supplied from either an electrical source or an optical source, such as a laser. When electrical sources are used, a thermal head can provide the heat to melt the ink layer. An example of a thermal head is one which consists of tantalum nitride thin film resistor elements, as described in Tokunaga, et al, IEEE Trans. on Electron Devices, Vol. ED-27, No. 1, January 1980, at page 218.

Laser printing is known in which light from laser arrays is used to provide the heat for melting and transferring the ink to a receiving medium. However, this type of printing is not very popular because lasers providing sufficient power are very expensive.

Another type of thermal transfer printing is one in which a resistive ribbon is provided containing a layer of fusible ink that is brought into contact with the receiving surface. The ribbon also includes a layer of resistive material which is brought into contact with an electrical power supply and selectively contacted by a thin printing stylus at those points opposite the receiving surface that are desired to be printed. When current is applied, it travels through the resistive layer and provides local resistive heating in order to melt a small volume of the fusible ink layer. This type of printing is exemplified by U.S. Pat. No. 3,744,611. An electrothermal printhead for use in combination with a resistive ribbon is shown in IBM Technical Disclosure Bulletin, Vol. 23, No. 9, February 1981, at page 4305.

In resistive ribbon thermal transfer printing, it is often the situation that the substrate contact to the head becomes unduly heated and debris accumulate on the printhead. This increases the contact resistance and develops heat in the printhead. To overcome the accumulation of debris and the increase in contact resistance, the amplitude of the applied current has to be increased. This can produce fumes and ruin the substrate.

A technique for reducing the amount of power required within a printhead in a resistive ribbon thermal transfer process is described in IBM Technical Disclosure Bulletin, Vol. 23, No. 9, February 1981, at page 4302. In this approach, a bias current is provided through a roller into the resistive layer located in the printing ribbon. This means that not all of the energy required to melt the ink has to be supplied through the printhead.

Another approach possibly providing some amplification of heat is that described in IBM Technical Disclosure Bulletin, Vol. 20, No. 2, July 1977, at page 808. In this reference, a photoconductive layer is located between two electrodes, across which is attached a power supply. When light strikes the photoconductor, it will be conductive in the region where it is hit by the light, and will close the circuit between the two electrodes. This provides a current flow where the current is a source of heat that develops in the photoconductor and is transferred to an adjacent ink layer. The ink layer is locally melted so that it can be transferred to a receiving medium.

In thermal transfer printing, it is known that the ink transfer efficiency and print quality depends upon the pressure, the thickness of the ink layer and the base, and the smoothness of the ink layer on the paper surfaces. These factors affect transfer efficiency and print quality for the same heating power and heat duration.

In the present invention, a technique has been discovered for alleviating some of the power requirements in thermal transfer printing. This technique is available to printers in which a thermal head (including laser print heads) is used to provide heat, and to printers in which resistive ribbons are used. Rather than using mechanical or electrical techniques for reducing the amount of power that is required to print, the present invention chemically provides heat amplification in any type of thermal transfer printing. This is accomplished by using an exothermic material which undergoes an exothermic reaction and is located close to, or in the ink layer. Application of a heat pulse or a current pulse in a printhead is merely a trigger to cause the exothermic material to locally produce heat, which aids in melting and/or transferring the ink.

Accordingly, this invention addresses some of the problems present in all types of thermal transfer printing, and has for a primary object a reduction in the amount of power required for thermal transfer printing.

It is another object of the present invention to provide thermal transfer printing of any kind in which clearer print images are provided with the same input power as would be used in printing applications without the improvement provided by the present invention.

It is another object of this invention to provide improved thermal transfer printing in which debris which accumulates in the printhead is reduced by reducing the magnitude of the required print current.

It is a further object of this invention to provide improved thermal transfer printing in which the contact time between the printhead or print stylus and the ink containing ribbon or layer is reduced.

It is another object of this invention to provide a technique for prolonging printhead life and for reducing the presence of fumes in thermal transfer printing.

It is another object of this invention to provide an inexpensive way to reduce power requirements in all types of thermal transfer printing.

It is another object of this invention to improve laser printing techniques in a manner to make them more economically feasible.

It is a further object of this invention to reduce current power requirements in thermal transfer printing in a manner which does not produce adverse or toxic fumes.

DISCLOSURE OF INVENTION

A technique is provided for chemically producing heat amplification in all types of thermal transfer printing. An exothermic material which undergoes an exothermic reaction is located close to, or in the ink layer. Application of a heat or current pulse is a trigger to cause the exothermic reaction to locally produce heat, which aids in melting and/or transferring the ink. This reduces the amount of power which must be applied in order to print.

The exothermic material is preferably a single component material which will be decomposed and undergo an exothermic reaction within the operative temperature range of the ink. Any type of ink can be used, and different types of exothermic reactions will produce different amounts of heat amplification. Suitable examples include non-aromatic azo compounds, peroxides, and strained valence isomers (such as quadricyclenes), dimers, trimers, and polymer materials. The use of an exothermic material will provide improved print quality for the same applied power, and can be used to reduce the applied power without affecting print quality.

These and other objects, features, and advantages will be apparent from the following more particular description of the preferred embodiments.

BRIEF DESCRIPTION OF THE DRAWING

FIG. 1.1 schematically illustrates a suitable ribbon for the practice of this invention in which the exothermic material is present in the ink layer.

FIG. 1.2 is a schematic illustration of a ribbon in which the exothermic material is present in another layer of the ribbon.

FIG. 2 illustrates another ribbon of the type used in thermal ink transfer, which does not include a conductive layer and in which the exothermic material can be present in the ink layer, in the base or support layer or in a separate layer of the ribbon. A thermal head is used with this ribbon in FIG. 2.

FIG. 3 shows a printing ribbon of the type shown in FIG. 2 which is used with laser printheads. The exothermic material can be an additive to the ink layer or support layer, or can be in a separate layer of this ribbon.

FIG. 4.1 is a graph of a representative ink, showing its heat flow characteristics as a function of temperature.

FIG. 4.2 is a heat flow versus temperature graph of a suitable exothermic additive, which illustrates the heat available for chemical heat amplification.

FIG. 4.3 is a heat flow versus temperature graph for another class of exothermic material suitable for providing heat amplification, this graph being for quadricyclene dicarboxylic acid (henceforth called quadricyclene diacid), which is a strained valence material.

BEST MODE FOR CARRYING OUT THE INVENTION

In the practice of this invention, chemical heat amplification is provided in any type of thermal transfer printing, in order to reduce the amount of applied energy which is required to effect ink melting and transfer. The chemical amplification is provided by an exothermic material which can be added to the ink formulation, or can be located in a separate layer. Also, the exothermic material can be located in the substrate of the ink-carrying ribbon, though this is not preferrable, since it would cause a large heat build-up in the support layer and possibly adverse fumes. If the exothermic material is located in a separate layer, it is generally supported by a binder, such as polyketone. Any polymeric binder that would form a film and easily adhere to other layers in the ink-bearing ribbon would be suitable.

The exothermic material providing chemical heat amplification is a material which will undergo an exothermic chemical action when heat is applied to it. The chemical heat amplification occurs only when external energy is applied to the ink in order to melt it. This externally applied heat can be from a thermal printhead, from current flow through a resistive layer of the ink bearing ribbon, or from heat produced by a laser printhead. The exothermic chemical action produces heat locally which is transferred to the ink in order to assist heating it to a temperature where its viscosity is correct for transfer to the receiving medium.

In general, the exothermic material used to provide heat amplification is chosen to be a material which is stable at room temperature, and which is non-volatile. It also should have a long lifetime (in excess of 100 years) at room temperature. It should be decomposed at temperatures greater than about 80° C., but typically less than 220° C. That is, it must decompose or change with heat evolution within the operating range of temperatures of the ink chosen for use. In this regard, the viscosity of the ink is the key parameter, since the viscosity must be sufficiently low at a set temperature to enable ink flow to the receiving medium.

Another criterion for choosing the exothermic heat amplification agent is the amount of heat provided when the material changes or decomposes. Generally, in excess of 200 J/gr is preferable, since it is desirable to have about 50% of the required energy for ink transfer be provided by the exothermic reaction. The exothermic material must also be non-toxic, and its decomposition products must be non-toxic. It is suitable if the decomposition products are volatile if the volatile products are not hazardous. For example, gases such as nitrogen and carbon dioxide are ideal volatile by-products of the decomposition. Still further, it is necessary that the decomposition products of the exothermic reaction not interfere with the rheological properties of the thermal printing system, such as the flow properties and printing quality provided by the ink.

It is generally desirable that the exothermic material be a single component material, since this provides more reliability in a practical system. For example, if two-component melting materials were used, the process would have to be such that the proper components would be adjacent to one another in order to provide the necessary exothermic chemical reaction. Also, the use of this exothermic material is limited to thermal transfer printing where the ink is melted for immediate transfer to the receiving medium. The exothermic material is not used in systems where the ink is melted a significant time prior to actual printing.

In a typical example, the exothermic material is in the solid ink layer in amounts of about 10–15 weight percent of the dry ink material. While this percentage range is usually preferred and typical, an extended range of 5–30 weight percent of the dry ink material has been found to be satisfactory. The amount of the exothermic material is calculated based on the operating temperatures of the ink and on the normal power requirements for the system that is chosen. Generally, it is not favorable to have an extremely large amount of chemical heat amplification, since the heat locally produced by the chemical reaction would then be sufficient to cause further chemical reactions which would spread like a fuse along the ink bearing ribbon. This would completely eliminate local ink transfer. A reduction of applied power of about 50% is usually appropriate, although smaller reductions can still represent good energy savings.

The exothermic material usually undergoes a decomposition reaction which yields heat and other by-products when a threshold temperature is reached. Thus, if the exothermic material M yields by-products X, Y and heat, the exothermic chemical reaction can be written as follows:

$$M \xrightarrow[>\text{threshold.}]{} X + Y + \text{heat}$$

The by-products X, Y should be non-toxic and not create adverse fumes or in any way affect the printing qualities of the ink. The heat which is produced by the exothermic reaction adds to the applied energy and generally is produced after the melting point of the ink is reached. Exothermic materials which decompose at lower temperatures and are otherwise suitable, are generally not available. However, since there is a fairly wide temperature difference between an ink's melting temperature and the temperature at which it flows to the receiving medium, many exothermic materials can be used. For most inks, it is sufficient if the exothermic reaction occurs between 80° C. and 220° C.

As stated previously, it is preferable that the exothermic material M be a single component, rather than a combination of components which would have to be carefully combined in a printing ribbon in order to trigger the exothermic reaction.

In the practice of this invention, different classes of material provide heat amplification within the temperature ranges used for most inks. One class of material is the nonaromatic azo compounds. These compounds can be incorporated into the ink formulation prior to coating the ink on the ribbon, or can be located in a separate layer, or possibly even in the support layer of the ribbon. A suitable azo compound is the following, which is available from the Aldrich Chemical Co.:

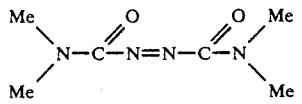

where Me=—$CH_3$ groups. This compound was synthesized by reacting

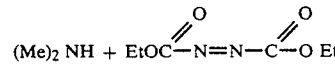

where Et=—$C_2H_5$ groups.

This reaction produced a crystalline product that was incorporated into the ink prior to coating on a ribbon.

In this particular example the exothermal decomposition of the product is as follows:

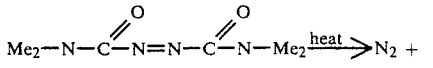

-continued

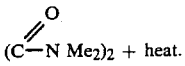

These are nontoxic materials of which only nitrogen ($N_2$) is volatile.

Other azo compounds that undergo thermolysis with heat evolution, and which are suitable for the practice of this invention are exemplified by the following list of compounds:

1,2-Δ-1,2-Diaza(3,6-Diphenylcyclohexane

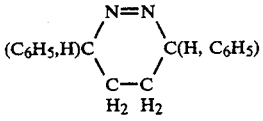

$4^{15}$ 1,2-Δ-1,2-Diaza(3,5-Dicyano 3,5-Dimethyl Cyclopenthane)

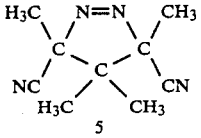

5

1,2-Diaza-(3,6-Dicyano-3,6-Dimethyl-Cyclohexane)

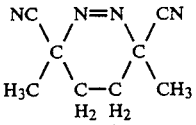

6

2,2'-Azobis(2-cyanobuthane)

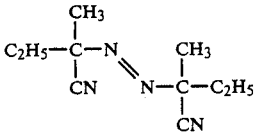

1,2-Δ-1,2-Diaza(3,3,5,5-Tetramethyl cyclopenthane)

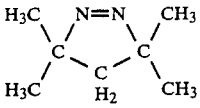

3(n = 5)

1,2-Δ-1,2-Diaza-(3,3,6,6-Tetramethyl cyclohexane)

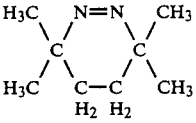

$3(n = 6)^{13,14}$ 1,2-Δ-1,2-Diaza-(3,3,8,8-Tetramethyl cyclooctane)

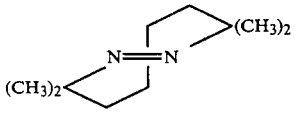

3(n = 8)

2,2-Azobis(2-Methylbuthane)

-continued

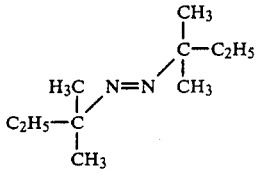

2,2'-Azobis(2-Methyl-propio-nitrille).

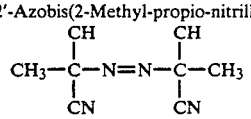

Generally, it is preferable that the by-products of the exothermic reaction be nonvolatile or, if volatile, be harmless and not create adverse fumes. Volatile products such as carbon dioxide and nitrogen are acceptable. The azo compounds specified so far, as well as other aliphatic azo compounds, are suitable.

Other suitable azo compounds include derivatives of azodicarbonamide and azodialkyldinitryl. Such derivatives include azodimethyl formamide and azodibutyrodinitrile and 1-azocyclohexane carbodinitrile.

Peroxide compounds are also suitable as the exothermic material, such peroxides being chosen from the group consisting of t-butyl perbenzoate, di-t-butyl peroxide, benzoyl peroxide, and metal persulfate.

Strained valence materials, including isomers, dimers, trimers, and polymers thereof are also suitable as exothermic materials. In these materials, the chemical bonding changes but no by-products are produced during the exothermic reaction. Strain in the materials is released quickly and the strained energy appears as heat. An example of the reaction which occurs is that for quadricyclanes, as follows:

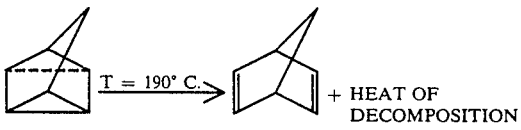

quadricycline derivatives are also suitable as exothermic materials, as exemplified by dicarboxy quadricyclane, its esters, and dicarboxyanhydro quadricyclane, N-arylimide quadricyclane, and N,N'-diarylquadricyclane di carboxamide. Representative structural formulas are the following:

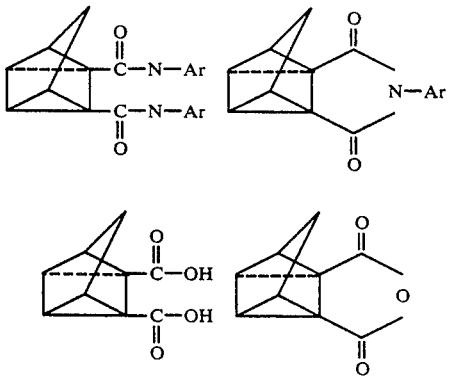

Other strained structures which can be used to provide chemical heat amplification include the following, which are described in G. Jones et al, J. Photochemistry, 10, p. 1-18 (1979).

1. 1-phenyl-2-(2-methylazo)cyclopropane

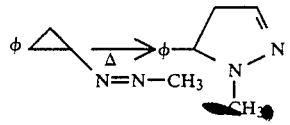

2. N—carbethoxy-2,3-dihydro-cyclobutene [b] pyrrole

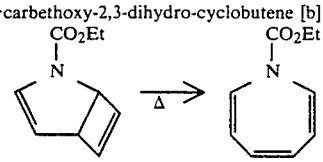

3. A photoproduct of Norbornene-3-ethylene

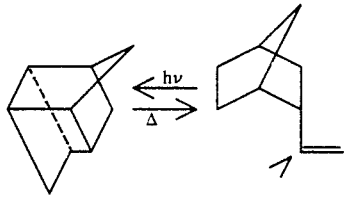

Norbornene-3-ethylene

4. A photoproduct of cyclooctadiene

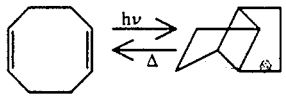

cyclooctadiene

5. A photoproduct of Limonene

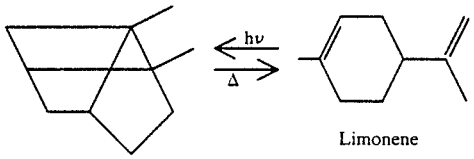

Limonene

APPLICATIONS TO THERMAL TRANSFER PRINTING (FIGS. 1.1, 1.2, 2 and 3)

These figures illustrate difference types of ink bearing ribbons and different types of thermal transfer printing. As explained previously, the use of chemical heat amplification is applicable to any type of thermal transfer printing where the ink is melted at the time it is to be transferred to the receiving medium. Chemical heat amplification is used to assist in bringing the ink viscosity to the proper level for transfer to the receiving medium.

In FIG. 1.1, the ink bearing ribbon 10 is located adjacent to the receiving medium 12, and includes a support layer 14, an ink bearing layer 16, a conductive material 18, and a resistive material 20. This type of ribbon is often used in resistive ribbon transfer printing of the type described previously. In this embodiment, the chemical heat amplification agent is an additive in ink layer 16. The nature of the various layers 14, 16, 18, 20 in ribbon 10 and their thicknesses are well known in the art. For example, the resistive layer 20 can be comprised of graphite dispersed in a binder, as is well known, or can be comprised of an inorganic resistive material, preferably a binary alloy, of the type taught in copending U. S. application Ser. No. 356,657, filed Mar. 10, 1982 in the names of A. Aviram and K. Shih and assigned to the present assignee. The support layer 14 can be comprised of Mylar (a trademark of E. I. DuPont De Nemours) while the conductive layer 18 can be comprised of aluminum. When aluminum is used for the conductor layer 18, a metal silicide resistive layer 20 is often used.

Of course, the conductive layer 18 can be absent, so that the resistive layer 20 is applied directly to the support layer 14. Also, the resistive layer 20 can be thick enough to provide support for the ribbon 10, so that support layer 14 will not be needed.

In the use of this ink-bearing ribbon 10, power is supplied to a stylus 19 brought into electrical contact with resistive layer 20. The resistive layer 20 is also in contact with a ground electrode 21. When the thin wire stylus 19 is applied to those regions of the ribbon 10 opposite the areas of the receiving medium 12 to which ink is to be transferred, the fusible ink layer 16 will locally melt due to localized resistive heating. At the same time, the exothermic reaction in the ink will produce heat, aiding in the heating and transfer process by which the ink is transferred from the layer 16 to the receiving medium 12.

Any type of ribbon, such as those used in the prior art, can be utilized in the practice of this invention. The following will therefore provide only a representative description of the various layers comprising these ribbons 10.

Support layer 14 is generally comprised of an electrically nonconductive material which is flexible enough to allow the formation of spools or other "wrapped" packages for storing and shipping. It is capable of supporting the remaining layers 16, 18, 20 of the ribbon 10 and is comprised of a material which does not significantly impede the transfer of thermal energy from the resistive layer 20 on one side of the support layer 14 to the fusible ink layer 16 on the other side, in order to increase the efficiency of printing. Of course, in the practice of this invention, this problem is minimized because of the chemical heat amplification which is provided. Although many materials may be employed as the support layer 14, the preferred material has often been "Mylar" polyester film. Other suitable materials include polyethylene, polysulphones, polypropylene, polycarbonate, polyvinylidene fluoride, polyvinylidene chloride, polyvinyl chloride, and Kapton (a trademark of E. I. Dupont deNemours).

The thicknesses of the support layer 14 and the other layers 16, 18, 20 of ribbon 10 are controlled to some degree by the required transfer of thermal energy and the ability to store the ribbon material, as well as by the machinery in which the ribbon 10 is used (for example, a computer terminal or typewriter). The support layer 14 is often about two-five micrometers in thickness.

In the practice of this invention, any type of ink composition can be used, the inks generally being comprised of a low melting point polymer binder and a colorant. The ink composition of layer 16 is not flowable at room temperature, but becomes flowable and transferrable upon heating. This causes a transfer of ink from the ribbon 10 to the paper 12 or other receiving medium during the printing process. A representative ink contains a polyamide and carbon black. A particular composition used as an example is versamide/carbon black mixture, which melts at approximately 90° C. This ink composition and many others are disclosed in U.S. Pat. No. 4,268,368.

In practice, the fusible ink layer 16 may be 4–6 micrometers in thickness. As noted previously, when the chemical amplification agent is located in the ink layer 16, it is typically present in an amount 10–15 atomic weight percent of the dry ink material. An extended range in which the invention may be practiced is 5–30 weight percent of the dry ink material.

In providing an ink formulation including the exothermic material, another typical example is a solution of 20 g Versamid 950 (produced by General Mills, Inc.) and carbon black (special black 4), plus isopropanol. The carbon black is present in an amount about 2% of the polymer, or 0.5 g. Eighty ml of isopropanyl is also used. In this ink formulation the amount of chemical additive is about 2 g. The ribbon support layer 14 is coated to a thickness of about 5 micrometers (dry thickness, i.e. after the solvent dries).

The support layer 14 may be coated with the fusible ink composition 16 by any of a number of well known coating methods, such as roll or spray coating.

In ribbon 10, the thin metallic layer 18 is typically 50–200 nm in thickness, a preferred thickness being approximately 100 nm. This layer 18 must be thin since it tends to spread the heat produced by the current flow. In some ribbons, the conductive layer 18 is a stainless steel strip, which also acts as the support layer. In other types of ribbons, the conductive layer 18 is omitted, and current flows only through the resistive layer 20. In this latter type of ribbon, heat is produced under the printing stylus 19 by the current crowding which occurs there.

Resistive layer 20 is either applied to a free surface of support layer 14, or to the surface of metallic layer 18, as in FIG. 1.1. The resistive material can be any of those used in conventional resistive ribbon transfer printing, or the inorganic binary alloys described in aforementioned copending application Ser. No. 356,657. Suitable binary alloys include the non-stoichiometric metal silicides having the general formula $M_{1-x}Si_x$. Alloys of two metallic elements may also be used. Generally, any number of elements of groups III and IV of the Periodic Table may be paired with a metal in the inorganic resistive layer 20. These resistive materials need not be supported in a polymeric binder. This has advantages, including the prevention of toxic fumes which may be released from such binders. The metals employed in the resistive layer 20 are chosen to be those which will not explosively, harmfully, or otherwise chemically react upon resistive heating. Metals such as nickel, cobalt, chromium, titanium, tungsten, molybdenum and copper are suitable.

The composition of the metal silicide may vary widely, and is generally selected on the basis of its resistivity. A resistivity of approximately 100–500 ohm-centimeters is preferred. Various compositional ranges are described in the aforesaid copending application. Typically the thickness of the resistive layer 20 is from about 0.5 micrometers to about 2 micrometers. The resistive layer 20 is applied to layer 18 of the ribbon 10 by well known techniques including vacuum evaporation and sputtering. Constant voltage power sources are preferred when binary alloys are used as the resistive material.

FIG. 1.2 shows another ribbon 22, which is similar to ribbon 10 in FIG. 1.1, except that the exothermic material is located in a separate layer 24, rather than in the ink layer 16. Since the ribbons 10, 22 are otherwise similar, the same reference numerals will be used to describe functionally equivalent layers in ribbons 10 and 22. The receiving medium is still designated 12. For ease of illustration, the stylus 19 and ground electrode 21 are omitted in FIG. 1.2. Therefore, ribbon 22 is comprised of a support layer 14, an ink bearing layer 16, a thin conductive layer 18, a resistive layer 20, and a layer 24 including the exothermic material used to provide chemical heat amplification. Layer 24 is located close to layer 16 in order to have the heat produced by the exothermic reaction easily transferred to the ink layer 16.

Layer 24 is typically comprised of a binder having the exothermic material therein. An example of such a binder is polyketone. This and many other types of binders can be used, the binder generally being a polymeric material which can be formed in a film and which easily adheres to support layer 14. The qualities used to select the support layer 14 can also be used to select the binder of layer 24.

When the exothermic material is located in a separate layer 24, it is generally preferred to make this layer 24 as thin as possible, since each layer 16, 24, 14, 18 and 20 of the ribbon 22 adds to the total thermal mass, and means that extra heat must be required for printing. Therefore, layer 24 has a maximum thickness of about 10,000Å. The additive in layer 24 is more concentrated than it is when it is in the ink layer 16, and is typically four or five times more concentrated. Thus, it is preferrably about 40–50% of the total solid weight of layer 24.

The foregoing explanations with respect to representative materials, thicknesses, and other properties of the various layers 14, 16, 18, 20 of the ribbon 10 also apply to ribbon 22, and to the other ribbons 26 shown in FIGS. 2 and 3.

FIG. 2 represents an ink transfer ribbon 26 including a support layer 28 and an ink-bearing layer 30. The chemical heat amplification additive is present in the ink layer 30.

The ribbon 26 of FIG. 2 is used in printing of the type where a thermal head 32 provides energy for melting the ink and transferring it to the receiving medium 12. Thus, the onset of energy from thermal head 32 causes an exothermic reaction in the ink layer 30, where this exothermic reaction aids melting and transfer of the ink to the receiving medium 12. In this embodiment, the amount of exothermic material located in the ink formulation is the same as that described previously.

FIG. 3 shows another type of thermal transfer printing using the same type of ribbon 26 as that in FIG. 2. The only difference is that the thermal head is now a laser array 34. For this reason, the same reference numerals are used for ribbon 26, including support layer 28 and ink-bearing layer 30.

Chemical heat amplification is particularly suitable in the environment of FIG. 3, since it means that the laser 34 does not have to supply all of the required power. This widens the number of lasers available for use, and significantly lowers the cost of the laser printhead.

In other types of resistive ribbons, the support layer is not required, and the function of support is provided by the resistive layer. In this case, the resistive layer is thicker (about 15 microns). This eliminates some thermal mass and the fumes which could be produced when a separate support layer is used. Examples of ribbons which use the resistive layer as the substrate (i.e., support layer) are shown in U.S. Pat. Nos. 4,268,368 and 3,744,611.

REPRESENTATIVE GRAPHS (FIGS. 4.1–4.4)

FIG. 4.1 plots the heat flow versus temperature of a representative ink. This plot was produced by differential scan colorimetry, and shows heat flow into and out of the ink, as a function of temperature. In FIG. 4.1, heat enters the ink as the temperature increases.

FIG. 4.2 illustrates heat flow into and out of a suitable exothermic material, being in this plot the azo compound 1, 1′ azobis (N, N-DIMETHYLFORMANIDE), which is also represented 1, 1-azobis DMF. This azo compound melts at approximately 111° C., as indicated by the sharp drop 36 in the curve. There is a latent heat of melting which occurs for the phase change from solid to liquid, the melting point being quite sharp for this compound. However, as the temperature continues to increase toward approximately 237° C., this material will undergo an exothermic reaction as indicated by the peak 38. The heat produced in this reaction is available to assist in melting the ink so that the ink can be transferred to the receiving medium. In this plot, approximately 92J/mol is available to assist melting and transferring of the ink.

FIG. 4.3 is a heat flow plot similar to those of FIGS. 4.1 and 4.2, except that it illustrates the heat producing behavior of the strained valence material quadricyclane diacid. In this plot, approximately 0.38kJ/gram is available from the exothermic reaction beginning at approximately 160° C. The peak amplitude of the heat which is produced in this reaction occurs at 178.3° C.

While many commercially available inks melt at a temperature of about 90° C., their viscosity upon melting is still too high to cause transfer to the receiving medium. In many cases they must be heated further, for example to 170°–190° C. Thus, the exothermic reaction does not have to occur at the melting point (although that would be advantageous) and can occur at a higher temperature. Depending on the temperature operating range of the ink, there is substantial leeway in choosing the exothermic material. The exothermic reaction should occur within the operative temperature range of the ink, whatever that may be and, in the case of presently available inks, is within 80°–220° C.

In the practice of this invention, chemical heat amplification is used to reduce the magnitude of the applied input power in thermal transfer printing, and for minimizing the problems which occur when the applied input power has to be increased. The additives can be placed either in the ink formulation, in a separate layer of the ribbon, or, less preferrably, in the support layer of the ribbon. By choosing an exothermic material which provides heat in the useful temperature range of operation of the ink, greater temperatures are achieved than would be achieved by the input power alone, and the characters so produced are sharper and have less voids. Typically 40–50% of the necessary heat energy can be provided by the exothermic reaction although any percentage gain is within the scope of this invention. Also, while ribbons are shown for carrying the ink-bearing layer, the term "ribbon" is meant to include any type of structure for carrying an ink-bearing layer.

While the invention has been described with respect to the particular embodiments thereof, it will be appreciated by those of skill in the art that many variations can be made without departing from the form and spirit of the present invention, which in its broadest sense is characterized as chemical heat amplification in thermal transfer printing.

Having thus described our invention, what we claim as new and desire to secure by Letters Patent is:

1. In thermal transfer printing an ink bearing ribbon comprising a support layer and at least one other layer, said one other layer including a fusible ink which is solid at room temperature and which includes a low melting point polymer binder and a suitable colorant, and an exothermic heat amplification material, said material giving off heat to said ink when its temperature is raised to at least a threshold amount.

2. The ribbon of claim 1, where said exothermic heat amplification material is chosen from the group consisting of those nonaromatic azo compounds, peroxides, and strained valence materials which undergo an exothermic reaction at temperatures between about 80° C. and 220° C. to release at least about 200 J/gram.

3. The ribbon of claim 2, where said azo compounds are derivatives of azodicarboxamide and azodialkyldinitril.

4. The ribbon of claim 2, where said azo compound is selected from the group consisting of azodimethyl formamide, azodibutyrodinitrile, and 1-azocyclohexane carbodinitrile.

5. The ribbon of claim 2, where said azo compounds are selected from the group consisting of 1,2-Δ-1,2-Diaza(3,6-Diphenylcyclohexane)
1,2-Δ-1,2-Diaza(3,5-Dicyano 3,5-Dimethyl Cyclopenthane)
1,2-Diaza-(3,6-Dicyano-3,6-Dimethyl-Cyclohexane)
2,2'-Azobis(2-cyanobuthane)
1,2-Δ-1,2-Diaza(3,3,5,5-Tetramethyl Cyclopenthane)
1,2-Δ-1,2-Diaza-(3,3,6,6-Tetramethyl Cyclohexane)
1,2-Δ-1,2-Diaza-(3,3,8,8-Tetramethyl Cyclooctane
2,2-Azobis(2-Methylbuthane)
2,2'-Azobis(2-Methyl-propio-nitrille).

6. The ribbon of claim 2, wherein said strained valence materials are selected from the group consisting of quadricyclanes and quadricycline derivatives selected from the group consisting of dicarboxy quadricyclane, its esters, dicarboxyanhydro quadricyclane N-Arylimide quadricylane, and N,N'-diarglquadricyclanedicarboxamide, 1-Phenyl-2-(2-methylazo) cyclopropane, N-carbethoxy-2,3-dihydrocyclobutene pyrrole, and the photoproducts of cyclooctadiene, limonene, and Norbornene-3-ethylene.

7. The ribbon of claim 1, where said exothermic material is located in said ink layer, and is present in an amount 5–30 weight percent of dry ink.

8. The ribbon of claim 1, where said exothermic material is located in a separate layer on said ribbon.

9. The ribbon of claim 1, where said exothermic material is located in said support layer of said ribbon.

10. In a thermal transfer printing process wherein energy is applied to an ink-bearing ribbon to melt and transfer ink in said ink-bearing ribbon to a receiving medium for printing thereon, the improvement wherein some of the heat required for said printing is provided by an exothermic chemical reaction of a chemical substance in said ribbon.

11. The method of claim 10, wherein said exothermic chemical reaction is produced locally, and occurs within the operative temperature range of said ink.

12. The method of claim 11, wherein said exothermic chemical reaction occurs at temperatures greater than about 80° C. and less than about 220° C.

13. The method of claim 12, where said exothermic chemical reaction provides heat in excess of approximately 200J/gram of said chemical substance.

14. The method of claim 13, where said exothermic chemical reaction is provided by the decomposition of said chemical substance, said chemical substance being stable at room temperature and decomposing at temperatures between approximately 80° C. and 220° C.

15. A method for thermal transfer printing, comprising the steps of:

bringing a ribbon containing a fusible ink which is solid at room temperature and a receiving medium into contact with one another, applying heat energy to a localized area of said ink to increase the temperature of said ink in said localized area, said heat energy being an amount sufficient to trigger an exothermic reaction in said ribbon, and chemically amplifying the amount of heat in said localized area by said exothermic reaction, the total amount of heat energy delivered to said localized area by said application of heat energy and said exothermic reaction being sufficient to cause melting of said ink and transfer of said melted ink to said receiving medium.

16. The method of claim 15, where said exothermic reaction is produced in said ink.

17. The method of claim 15, where said exothermic reaction is produced in a layer in said ribbon separate from said ink.

18. The method of claim 15, where said exothermic reaction is produced by the decomposition of an exothermic material in said ribbon upon the application of said heat energy.

19. The method of claim 18, where said material is chosen from the group consisting of those nonaromatic azo compounds, peroxides, and strained valence materials which exhibit an exothermic reaction between approximately 80° C. and 220° C.

20. The method of claim 18, where said heat energy is applied from a heat-producing thermal head brought into contact with said ribbon.

21. The method of claim 18, where said heat energy is applied from a laser printhead which directs photons to said ribbon.

22. The method of claim 18, where said heat energy is supplied by the passage of electrical current through a resistive layer in said ribbon.

23. An apparatus for thermal transfer printing of ink onto a receiving medium, comprising:

a ribbon including a substrate, an inkbearing layer, and an exothermic material which yields heat in an exothermic reaction upon being heated to a threshold temperature, and means for heating said exothermic material in a localized volume to at least said threshold temperature, and for supplying heat to a localized volume of said ink, the total amount of heat delivered to said localized volume of ink by both said means for heating and said exothermic reaction being sufficient to melt and transfer said ink in said localized volume to said receiving medium.

24. The apparatus of claim 23, where said means for heating is a thermal printhead brought into contact with said ribbon.

25. The apparatus of claim 23, where said means for heating is a laser printhead for directing photons to said ribbon.

26. The apparatus of claim 23, where said means for heating is a resistive current-carrying layer in said ribbon.

27. The apparatus of claim 23, where said exothermic material is located in said ink-bearing layer.

28. The apparatus of claim 27, where the amount of exothermic material in said ink-bearing layer is in the range 5–30 weight percent of dry ink material.

29. The apparatus of claim 23, where said exothermic material is located in a layer separate from said ink-bearing layer.

30. The apparatus of claim 23, where said exothermic material is selected from the group consisting of those nonaromatic azo compounds, peroxides, and strained valence materials which undergo exothermic reactions between approximately 80° C. and 220° C.

31. The apparatus of claim 30, where said exothermic material produces heat in excess of 200J/gram of said material during said exothermic reaction.

* * * * *